US007942409B2

(12) United States Patent
Ishikawa et al.

(10) Patent No.: US 7,942,409 B2
(45) Date of Patent: May 17, 2011

(54) SHEET CONVEYING APPARATUS AND IMAGE FORMING APPARATUS

(75) Inventors: Naoki Ishikawa, Kashiwa (JP); Hitoshi Kato, Toride (JP); Yasuo Fukatsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 12/493,897

(22) Filed: Jun. 29, 2009

(65) Prior Publication Data

US 2009/0322012 A1 Dec. 31, 2009

(30) Foreign Application Priority Data

Jun. 30, 2008 (JP) ..... 2008-171735

(51) Int. Cl.
*B65H 7/02* (2006.01)

(52) U.S. Cl. ..... 271/228; 271/227

(58) Field of Classification Search ..... 271/227, 271/228

See application file for complete search history.

(56) References Cited

U.S. PATENT DOCUMENTS

| | | | | |
|---|---|---|---|---|
| 6,779,791 | B2 * | 8/2004 | Kawamura et al. | 271/228 |
| 7,401,776 | B2 * | 7/2008 | Obuchi et al. | 271/228 |
| 7,798,490 | B2 * | 9/2010 | Tamura et al. | 271/227 |
| 2008/0240820 | A1 * | 10/2008 | deJong et al. | 399/395 |

FOREIGN PATENT DOCUMENTS

| | | | |
|---|---|---|---|
| JP | 2007-001761 | A | 1/2007 |
| JP | 2007-069993 | A | 3/2007 |

* cited by examiner

*Primary Examiner* — Stefanos Karmis
*Assistant Examiner* — Ernesto Suarez
(74) *Attorney, Agent, or Firm* — Canon USA Inc IP Division

(57) ABSTRACT

A sheet conveying apparatus includes a first conveyance unit to convey a sheet, a second conveyance unit to convey the sheet received from the first conveyance unit, a sheet detection unit to detect an edge position of the sheet in a lateral direction intersecting a sheet conveyance direction of the second conveyance unit, a sheet shifting unit to shift the sheet conveyed by the second conveyance unit in the lateral direction, a computing unit to compute a difference between the detected edge position of the sheet and a reference position, a position correction unit to control a shifting amount of the sheet by the sheet shifting unit based on the difference computed by the position correction unit to correct a sheet position in the lateral direction, and a conveyance interval control unit to shorten a sheet conveyance interval of the first conveyance unit if the computed difference is equal to or less than a predetermined amount.

13 Claims, 17 Drawing Sheets

SHIFT IN BACK SIDE

SHEET CONVEYING APPARATUS AND IMAGE FORMING APPARATUS

FIELD OF THE INVENTION

The present invention relates to a sheet conveying apparatus and image forming apparatus having a function of shifting a sheet to be conveyed.

DESCRIPTION OF THE RELATED ART

A recent image forming apparatus which forms an image on a sheet was generally connected with a sheet processing apparatus which is referred to as a finisher. The finisher aligns side edges of sheets discharged from the image forming apparatus, and performs a stapling process or a punching process on a bundle of sheets, and a sorting process. The finisher also has a function to discharge the bundles of sheets so as to be offset to one another in a direction perpendicular to a sheet conveyance direction during the sorting process in order to discriminate each of the bundles of sheets on a discharge tray.

When the stapling process or the punching process is to be performed, the conveyed sheets first need to be aligned before these processes in order to improve a quality of a finished product. In order to align the conveyed sheets, it is necessary to shift the sheets to correct positions of the sheets. Similarly, the offset operation of the sheets also requires shifting of the sheets.

The finisher detects the position of the conveyed sheet in the direction perpendicular to the sheet conveyance direction (hereinafter referred to as a "lateral direction") and shifts the sheet by a predetermined amount in the lateral direction based on a result of the detection. At the time, since the sheet is shifted by the predetermined amount, it is required to start the next process in consideration of shifting time. Japanese Patent Application Laid-Open No. 2007-001761 discusses a method for shifting a sensor which detects a sheet edge position (hereinafter referred to as a lateral registration sensor) in the width direction from a reference position. The sensor is configured to calculate a deviation amount of the conveyed sheet based on the shifting amount of the lateral registration sensor before the lateral registration sensor detects the sheet edge. The sheet is then shifted in the width direction based on a calculated result, thereby correcting a lateral deviation of the sheet and controlling the position of the sheet in the width direction.

Recently, an image forming apparatus has been required to discharge a sheet on which an image is formed, from a post-processing apparatus with improved productivity. However, increases in a size of the apparatus and a number of sheet processing apparatuses which are connected thereto may increase a lateral deviation of a conveyed sheet before the sheet reaches the post-processing apparatus which is arranged downstream of the apparatus. Thus, the post-processing apparatus needs to have a function to deal with an increase of a lateral deviation amount. In the conventional sheet processing apparatus, a predictable maximum value of a lateral deviation amount of a sheet is determined and a sheet conveyance interval is determined based on a time period required for correction of the lateral deviation amount of the sheet. In other words, as the lateral deviation amount of the sheet becomes larger, correcting time becomes longer. Since an appropriate distance between the sheets needs to be kept according to the correcting time, productivity is decreased if the maximum correcting time becomes longer.

Further, if a sheet processing apparatus arranged upstream of the post-processing apparatus has a mechanism for correcting a lateral deviation of a sheet, a correction amount of the lateral deviation of the sheet in the post-processing apparatus can be reduced.

On the other hand, if the lateral deviation amount of the sheet is smaller than the above-described maximum value, a time period elapsed from completion of the correction to arrival of a next sheet becomes longer in comparison with a case where the lateral deviation amount of the sheet is the maximum value. However, conventional apparatus does not effectively use the time period which is caused when the lateral deviation amount of the sheet is smaller than the maximum value.

SUMMARY OF THE INVENTION

The present invention is directed to a sheet conveying apparatus and an image forming apparatus which can use a time period from completion of correction to arrival of a next sheet which is caused by reduction of a lateral deviation amount of a sheet to improve productivity of the image forming apparatus.

Further, the present invention is directed to a sheet conveying apparatus and an image forming apparatus which can appropriately control a sheet conveyance interval according to variation of a lateral deviation amount of a sheet to be conveyed.

According to an aspect of the present invention, a sheet conveying apparatus includes a first conveyance unit configured to convey a sheet, a second conveyance unit configured to convey the sheet received from the first conveyance unit, a sheet detection unit configured to detect an edge position of the sheet in a lateral direction intersecting a sheet conveyance direction of the second conveyance unit, a sheet shifting unit configured to shift the sheet conveyed by the second conveyance unit in the lateral direction, a computing unit configured to compute a difference between the sheet edge position detected by the sheet detection unit and a reference position, a position correction unit configured to control a shifting amount of the sheet to be shifted by the sheet shifting unit based on the difference computed by the computing unit in order to correct a position of the sheet in the lateral direction, and a conveyance interval control unit configured to shorten a sheet conveyance interval of the first conveyance unit when the difference computed by the computing unit is equal to or less than a predetermined amount.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
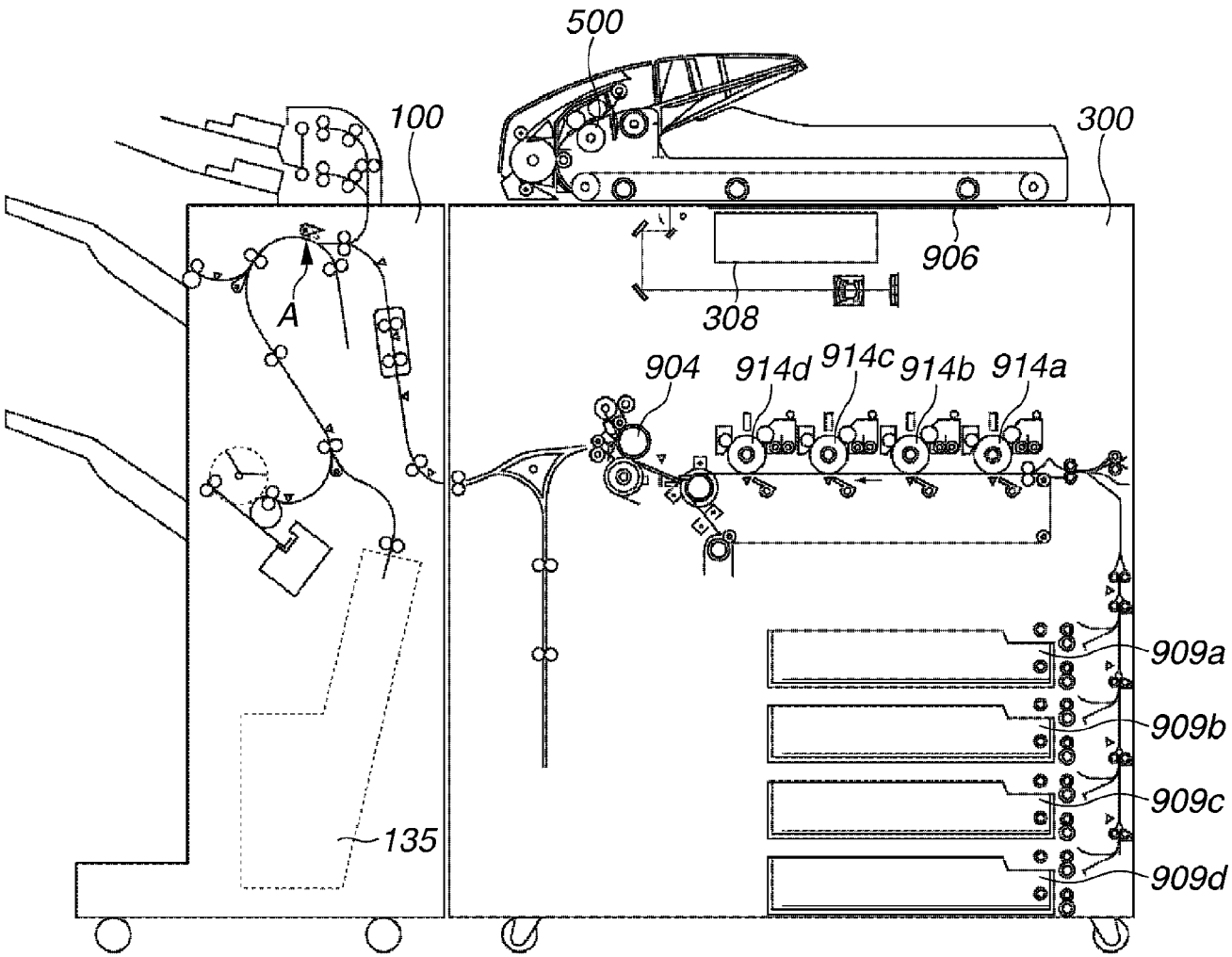
FIG. 1 is a cross sectional view of an image forming apparatus.

FIG. 1 is a cross sectional view of an image forming apparatus according to a first exemplary embodiment. The image forming apparatus includes an image forming apparatus 300 and a sheet processing apparatus 100. The sheet processing apparatus 100 as a sheet conveying apparatus is connected to the image forming apparatus 300 and includes a saddle stitch binding processing unit 135 and a side stitch binding processing unit as a sheet stacking processing unit. Therefore, the sheet processing apparatus 100 can process a sheet discharged from the image forming apparatus 300 online. The sheet processing apparatus 100 and the image forming apparatus 300 may be integrated into one apparatus.

Sheet cassettes 900*a* to 900*d* serves as sheet storing units and sheet feeding units for feeding sheets stored therein. Image forming units 914*a* through 914*d* form a yellow toner image, a magenta toner image, a cyan toner image, and a black toner image, respectively. The four color-toner images are sequentially transferred to a sheet fed from the sheet cassette so as to be overlapped with one another. The sheet on which toner images are transferred is conveyed to a fixing device 904 where the toner images are fixed onto the sheet. The sheet, after the toner images are fixed, is discharged to the sheet processing apparatus 100.

Figure 2:
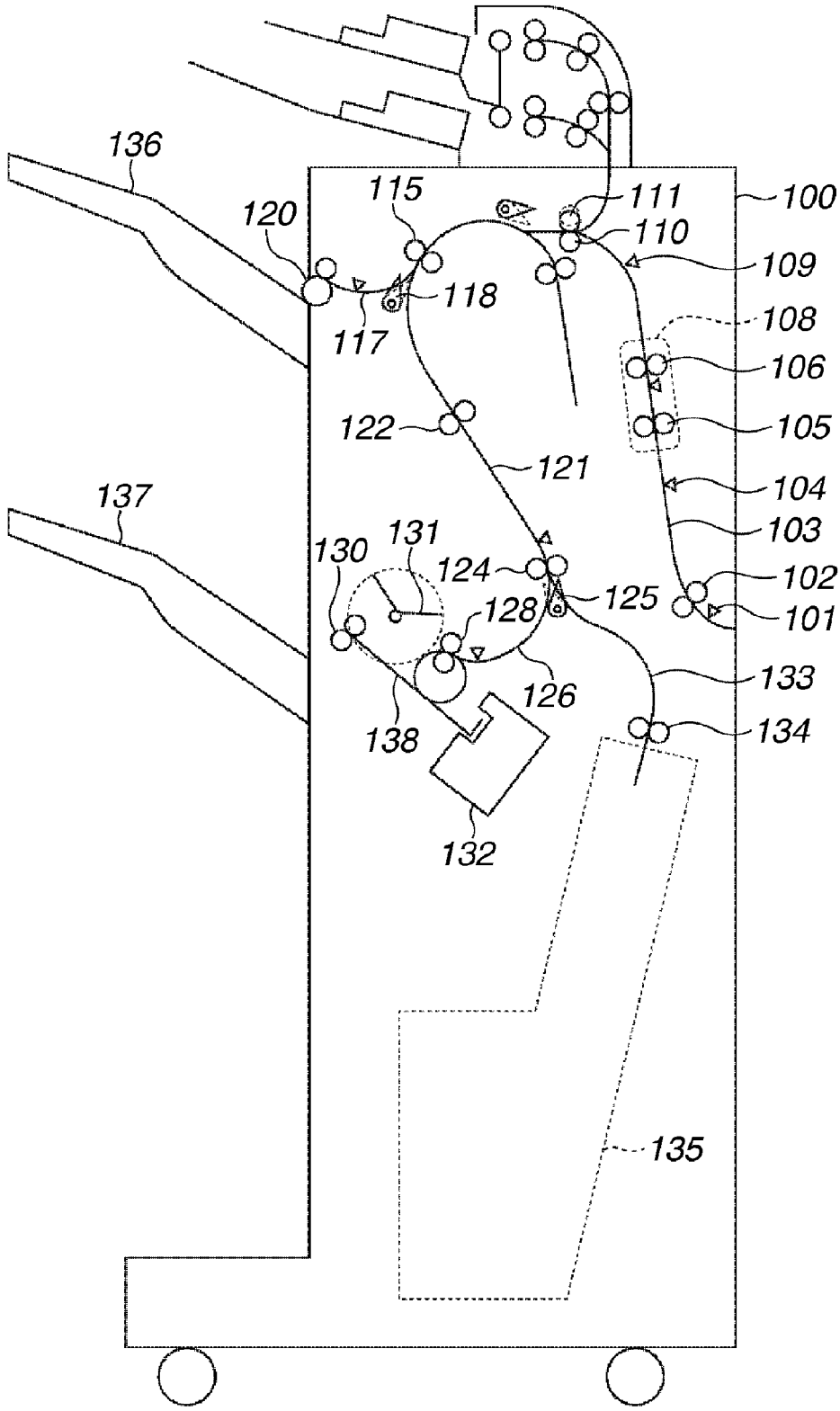
FIG. 2 is a cross sectional view of a sheet processing apparatus.

The sheet processing apparatus 100 will be described below with reference to FIG. 2.

The sheet discharged from the image forming apparatus 300 is transferred to an inlet roller pair 102 of the sheet processing apparatus 100. In other words, the image forming apparatus 300 serves as a first conveyance unit and an upstream side device. At the same time, timing of transferring the sheet is detected by an inlet sensor 101. A sheet edge position in a lateral direction is detected by a lateral registration detection sensor 104 while the sheet conveyed from the inlet roller pair 102 is passing through a conveying path 103. Based on the detected sheet edge position, how much lateral deviation from a reference position (shifting amount from a reference position) occurs is detected.

The sheet is conveyed through shift roller pairs 105 and 106 of a shift unit 108. More specifically, the shift roller pairs 105 and 106 serves as a conveyance unit and a second conveyance unit. The shift unit 108 is shifted by an amount corresponding to a lateral deviation amount of the sheet in a lateral direction perpendicular to the sheet conveyance direction (forward and rearward directions of FIG. 2) while the shift roller pairs 105 and 106 are conveying the sheet. Accordingly, the sheet is shifted in the lateral direction. The shift unit 108 returns to the reference position (home position) after the sheet passes through the shift unit 108 to shift the next sheet.

The sheet is further conveyed by a conveyance roller 110, a separating roller 111, and a buffer roller pair 115. When the sheet is discharged to an upper tray 136, a diverter 118 is set at a position illustrated by a broken line in FIG. 2 by a driving mechanism using a solenoid or the like (not shown) and is positioned on a side of an upper conveyance path 117. As a result, the sheet is discharged to the upper tray 136 by an upper discharge roller 120.

When the sheet is not discharged to the upper tray 136, the sheet conveyed by the buffer roller pair 115 is guided to a sheet bundle conveyance path 121 by the diverter 118 and is further conveyed by a roller pair 122 and a sheet bundle conveyance roller pair 124. When the sheets are subjected to saddle stitch binding processing, a diverter 125 is set at a position illustrated by a broken line by the driving mechanism using a solenoid or the like (not illustrated). As a result, the sheets are conveyed to a saddle path 133 and guided to the saddle stitch binding processing unit 135 by a saddle inlet roller pair 134 where the sheets are subjected to the saddle stitch binding processing. The saddle stitching binding processing is commonly used and is not a substantial part of the present invention, so that a detailed description thereof will be omitted here.

When the sheet is discharged to a lower tray 137, the sheet conveyed to the sheet bundle conveyance roller pair 124 is guided to a lower path 126 by the diverter 125, and discharged to an intermediate process tray 138 by a lower discharge roller pair 128. The sheet discharged to the intermediate process tray 138 is aligned thereon by a return mechanism using a paddle 131, a knurled belt (not shown) and the like, and is further subjected to binding processing by using a stapler 132, as required. Then the sheet is discharged to the lower tray 137 by a sheet bundle discharge roller pair 130.

Figure 3:
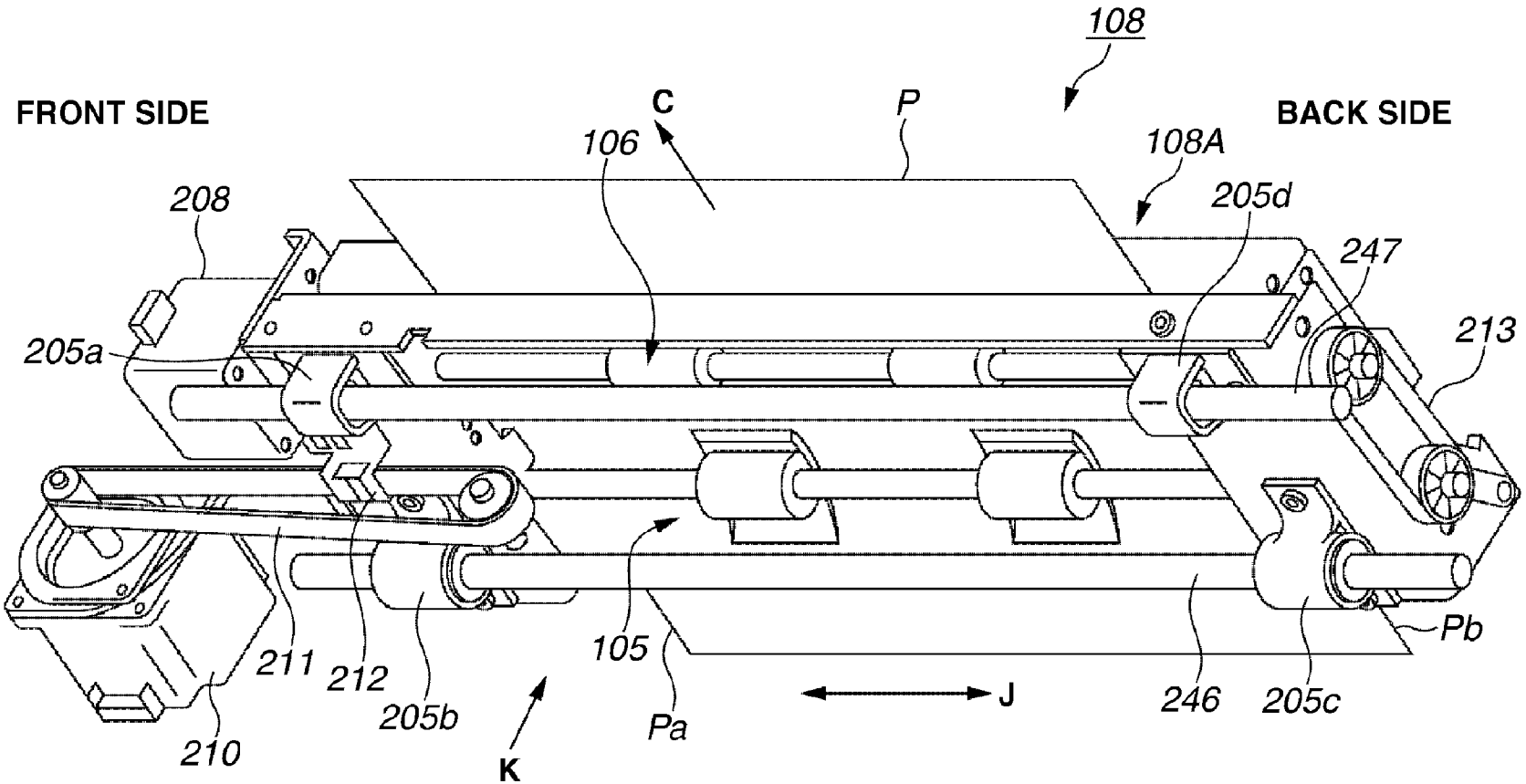
FIG. 3 is a perspective view illustrating an outer appearance of a shift unit.
Figure 4:
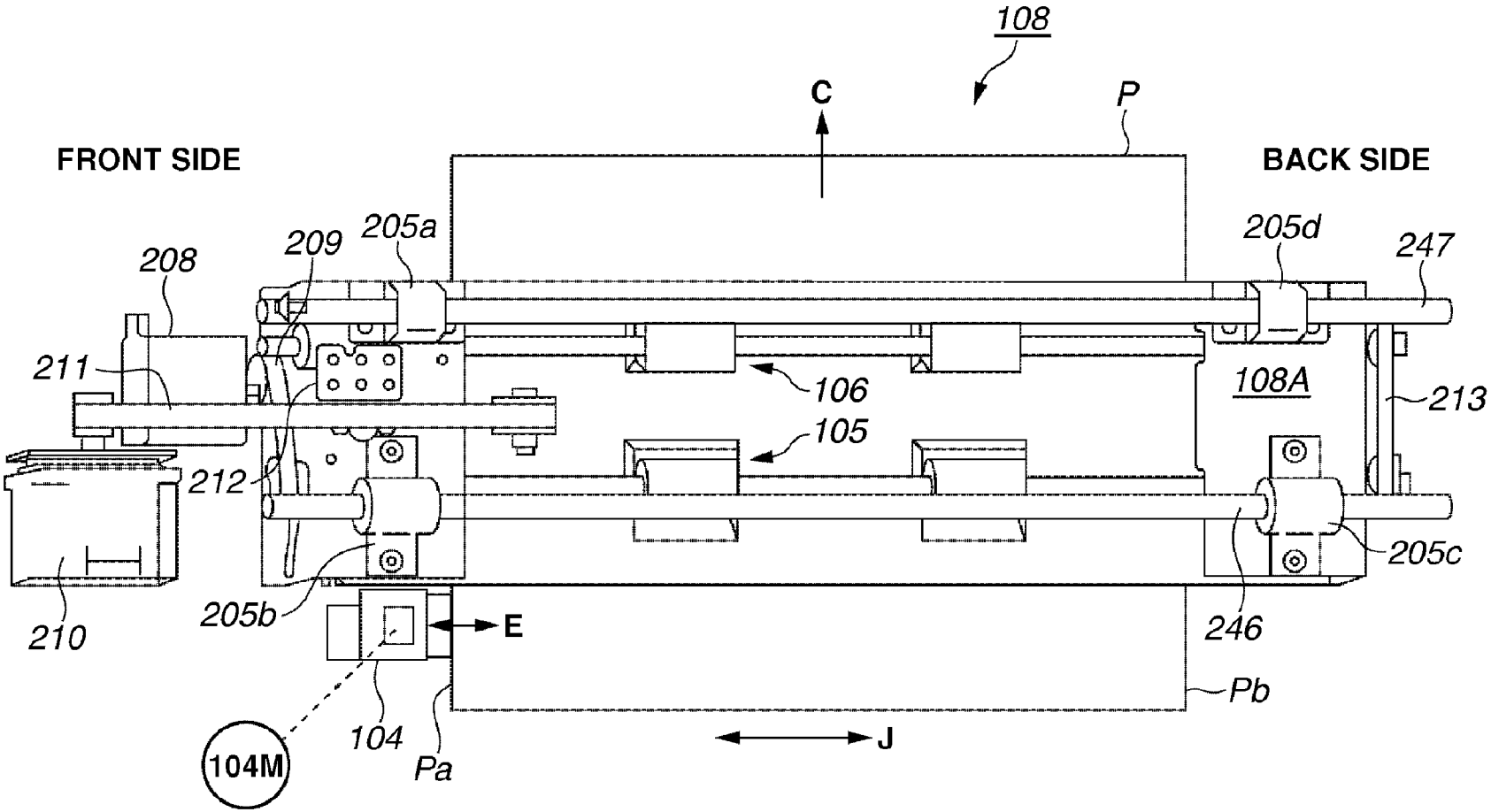
FIG. 4 illustrates the shift unit of FIG. 3 viewed from an arrow K direction.

FIG. 3 is a perspective view illustrating an outer appearance of the shift unit 108. FIG. 4 illustrates the shift unit 108 of FIG. 3 viewed from an arrow K direction.

A frame 108A of the shift unit 108 is supported by sliding bushes 205*a*, 205*b*, 205*c*, and 205*d* which are freely movable on sliding rails 246 and 247 fixed to the sheet processing apparatus 100, and can be moved side to side in an arrow J direction. The arrow J direction is perpendicular to the sheet conveyance direction and is the sheet lateral direction.

The frame 108A of the shift unit 108 is provided with a shift conveyance motor 208 and the shift roller pairs 105 and 106. The shift conveyance motor 208 rotates the shift roller pair 105 via a driving belt 209 (see FIG. 4). Further, the shift roller pair 105 rotates the shift roller pair 106 via a driving belt 213.

The shift unit 108 is provided with a shift motor 210. The shift motor 210 is rotated under control of a sheet processing apparatus control unit 501, which will be described below, to circulate a driving belt 211. The driving belt 211 is coupled with the frame 108A by a coupling member 212. Therefore, the frame 108A can be moved in the arrow J direction by the driving belt 211 which circulates. Movement of the frame 108A of the shift unit 108 in the arrow J direction is performed while a sheet P is pinched between the shift roller pairs 105 and 106. In other words, the shift motor 210 serves as a second driving device which moves the shift roller pairs 105 and 106 as the second conveyance unit.

As is illustrated in FIG. 4, there is a lateral registration detection sensor 104 provided in the vicinity of the shift unit 108. The lateral registration detection sensor 104 can be shifted in an arrow E direction by a pulse motor 104M. The arrow E indicates the same direction as the arrow J. The lateral registration detection sensor 104 includes a photosensor which detects the presence or absence of a sheet. More specifically, the lateral registration detection sensor 104 functions as a sheet detection device, and the pulse motor 104M functions as a first driving device for shifting the sheet detection device.

Figure 5:
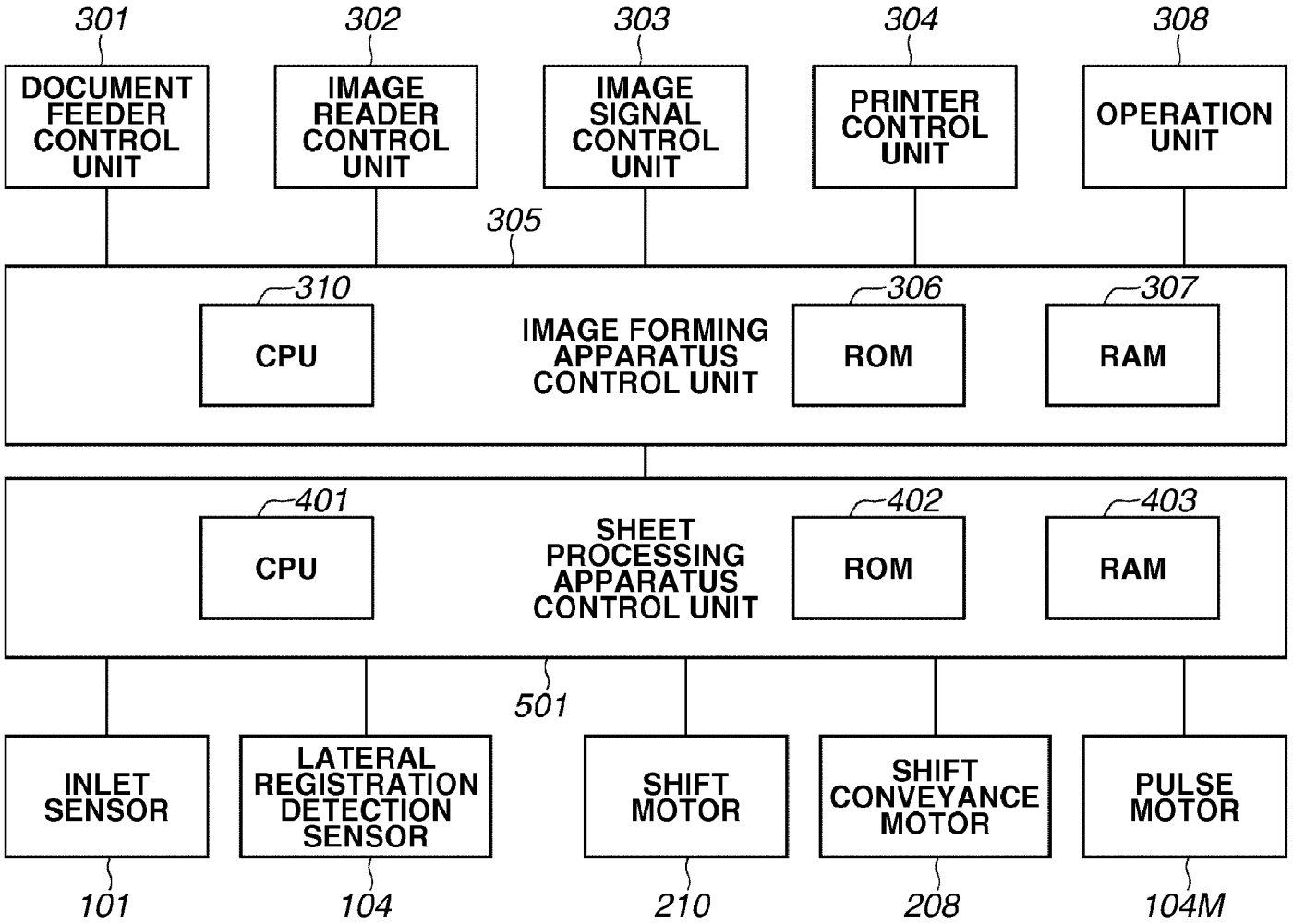
FIG. 5 is a control block diagram of the image forming apparatus.

FIG. 5 is a control block diagram of the image forming apparatus 300 and the sheet processing apparatus 100 of the image forming apparatus.

A control unit 305 is a control unit for the image forming apparatus 300. A control unit 501 is a control unit for the sheet processing apparatus 100. The image forming apparatus control unit 305 includes a central processing unit (CPU) 310, and a read-only memory (ROM) 306 and a random access memory (RAM) 307 as storage units. A control program stored in the ROM 306 totally controls a document feeder control unit 301, an image reader control unit 302, an image signal control unit 303, a printer control unit 304, an operation unit 308, and the sheet processing apparatus control unit 501. The RAM 307 is used to temporarily store control data, or to store data as a work area for arithmetic processing required for the control.

The document feeder control unit 301 controls driving of an automatic sheet feeder 500 (see FIG. 1) based on an instruction of the image forming apparatus control unit 305. The image reader control unit 302 controls driving of the light sources and reading elements, and transfers to an image signal control unit 303 an analogue image signal of RGB color information which is obtained by reading an image on a document.

The image signal control unit 303 converts the analogue image signal into a digital signal. The converted digital signal is subjected to various processing. The image signal control unit 303 further converts the digital signal into a video signal containing YMCK color information to output the video signal to the printer control unit 304. Processing of the image signal control unit 303 is controlled by the image forming apparatus control unit 305.

The operation unit 308 includes a plurality of keys for setting various functions relating to image formation, a display unit for displaying information indicating setting states, and the like. Key signals corresponding to key operations on the operation unit 308 are sent to the image forming apparatus control unit 305 serving as a computing unit and an input unit. Further, in the display unit or the like of the operation unit 308, corresponding information is displayed based on the signal from the image forming apparatus control unit 305.

The sheet processing apparatus control unit 501 communicates information data with the image forming apparatus control unit 305 via a communication IC (not illustrated) and a communication link and controls driving of the entire sheet processing apparatus 100. The sheet processing apparatus control unit 501 includes a CPU 401, a ROM 402, and a RAM 403. The sheet processing apparatus control unit 501 controls various actuators and various sensors based on a control program stored in the ROM 402. For example, the inlet sensor 101 and the lateral registration detection sensor 104 of FIG. 2, the shift motor 210, the shift conveyance motor 208, and the pulse motor 104M of FIG. 3 are controlled by the sheet processing apparatus control unit 501. Further, the RAM 403 is used to temporarily store control data and as a work area for arithmetic processing involved in control. The CPU 310 sends, just before each sheet is discharged to the sheet processing unit 100, information data to the sheet processing apparatus control unit 501 via a communication IC (not illustrated) and a communication link. The information data represents a sheet size and a sheet conveyance interval between the sheet and the previous sheet. The information data about the sheet conveyance interval may be sent out only when the interval is changed. Similarly the information data about the sheet size may only be sent out when the sheet size is changed.

The lateral registration detection sensor 104, as described above, detects the amount of lateral deviation from the reference position in the lateral direction of the sheet conveyance path, and is arranged upstream of the shift unit 108 in order to compute the shifting amount thereof.

Figure 6:
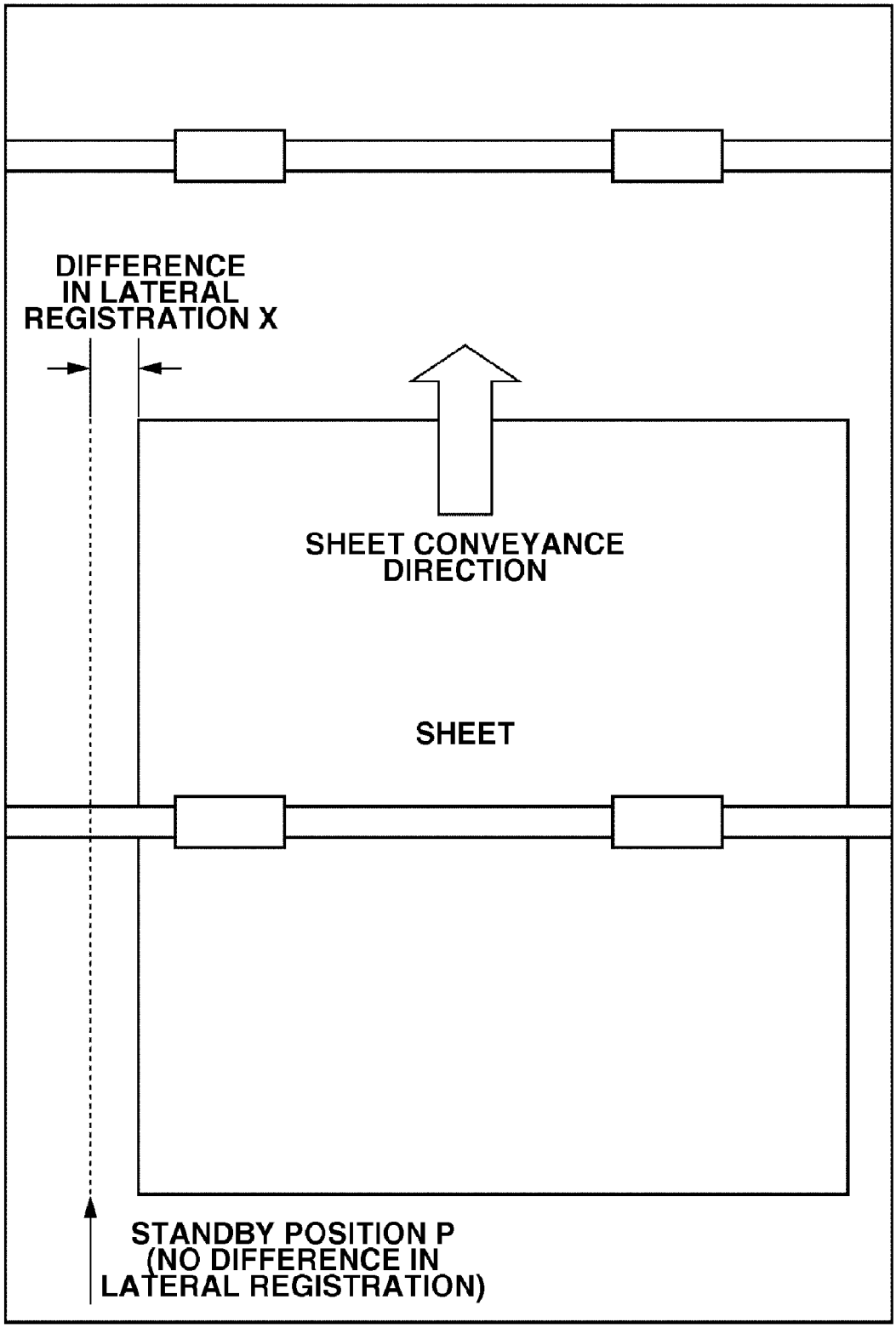
FIG. 6 illustrates a lateral deviation amount of a sheet.

FIG. 6 illustrates the state where there is a lateral shift from the reference position in the lateral direction. The reference position corresponds to a standby position P in FIG. 6. A sheet may be conveyed to the finisher being shifted by a distance X from the standby position P in the lateral direction. The distance X is detected by the lateral registration detection sensor 104 as the lateral deviation amount. The lateral registration detection sensor 104 becomes ON when a sheet is detected, whereas the lateral registration detection sensor 104 is in an OFF state when no sheet is detected.

Figure 7:
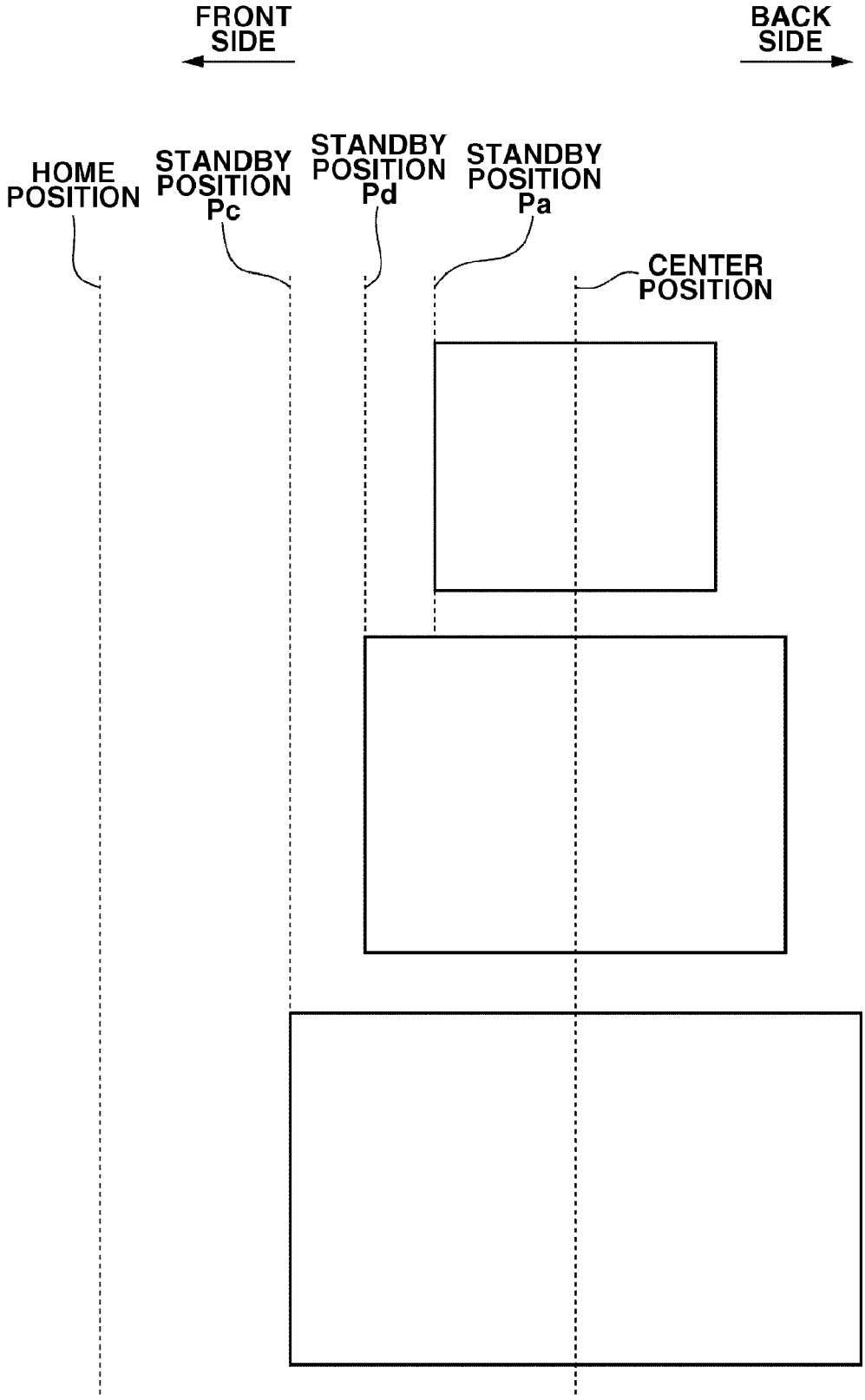
FIG. 7 illustrates standby positions of a lateral registration detection sensor.

FIG. 7 illustrates a home position HP and a plurality of standby positions Pa, Pc, Pd which are different to one another according to sheet sizes and sheet conveyance directions.

When a sheet is not laterally deviated, regardless of the sheet size, a center position of the sheet coincides with a center position of the sheet conveyance path. When no sheet is conveyed, the lateral registration detection sensor 104 stands ready at the home position HP. When sheet conveyance is started, the lateral registration detection sensor 104 is shifted to the standby position P by the pulse motor 104M to wait for the sheet to be conveyed. The home position HP is set at a front side of the sheet conveyance path in the lateral direction and the position of the lateral registration detection sensor 104 is controlled based on the home position HP as the reference position. Whether the lateral registration detection sensor 104 is positioned at the home position HP is detected by a home position (HP) detection sensor (not illustrated).

The standby positions P (Pa, Pc, Pd) are side edge positions of sheets when the sheet is not laterally deviated. The standby positions P are determined according to the sheet sizes (including orientations thereof). Information about the sheet sizes is sent from the document feeder control unit 301 to the sheet processing apparatus control unit 501 before the sheet conveyance is started. As illustrated in FIG. 7, as the sheet size in the lateral direction becomes larger, the standby position P moves from the center position to the front side of the sheet conveyance path. The lateral registration detection sensor 104 is shifted to the standby position P by driving the pulse motor 104M, so that the CPU 401 determines a number of pulses corresponding to a distance from the home position HP to the standby position P according to the sheet size.

A method for detecting a lateral deviation amount of a sheet by the lateral registration detection sensor 104 will be described below with reference to FIG. 8.

When a conveyed sheet reaches the lateral registration detection sensor 104, the pulse motor 104M shifts the lateral registration detection sensor 104 in the lateral direction to cause it to detect a sheet edge. Then, a shifting amount of the lateral registration detection sensor 104 until the lateral registration detection sensor 104 detects the sheet edge is computed.

The shifting amount of the lateral registration detection sensor 104 is computed based on an advancing amount per step of the pulse motor 104M and the number of pulses from the standby position P until the sheet edge is detected.

$$(\text{shifting amount})D=(\text{advancing amount})s\times(\text{the number of pulses})p$$

Based on the shifting amount D, the lateral deviation amount can be computed. Based on the computed lateral deviation amount, the lateral registration shift unit 108 is shifted to correct a sheet position.

The lateral registration detection sensor 104 is shifted back to the standby position P after completing of the detection of the sheet edge and waits for the next sheet to arrive. Then, when it is determined that the next sheet reaches a position of the sensor, the lateral registration detection sensor 104 starts detecting the sheet edge of the next sheet.

Figure 8:
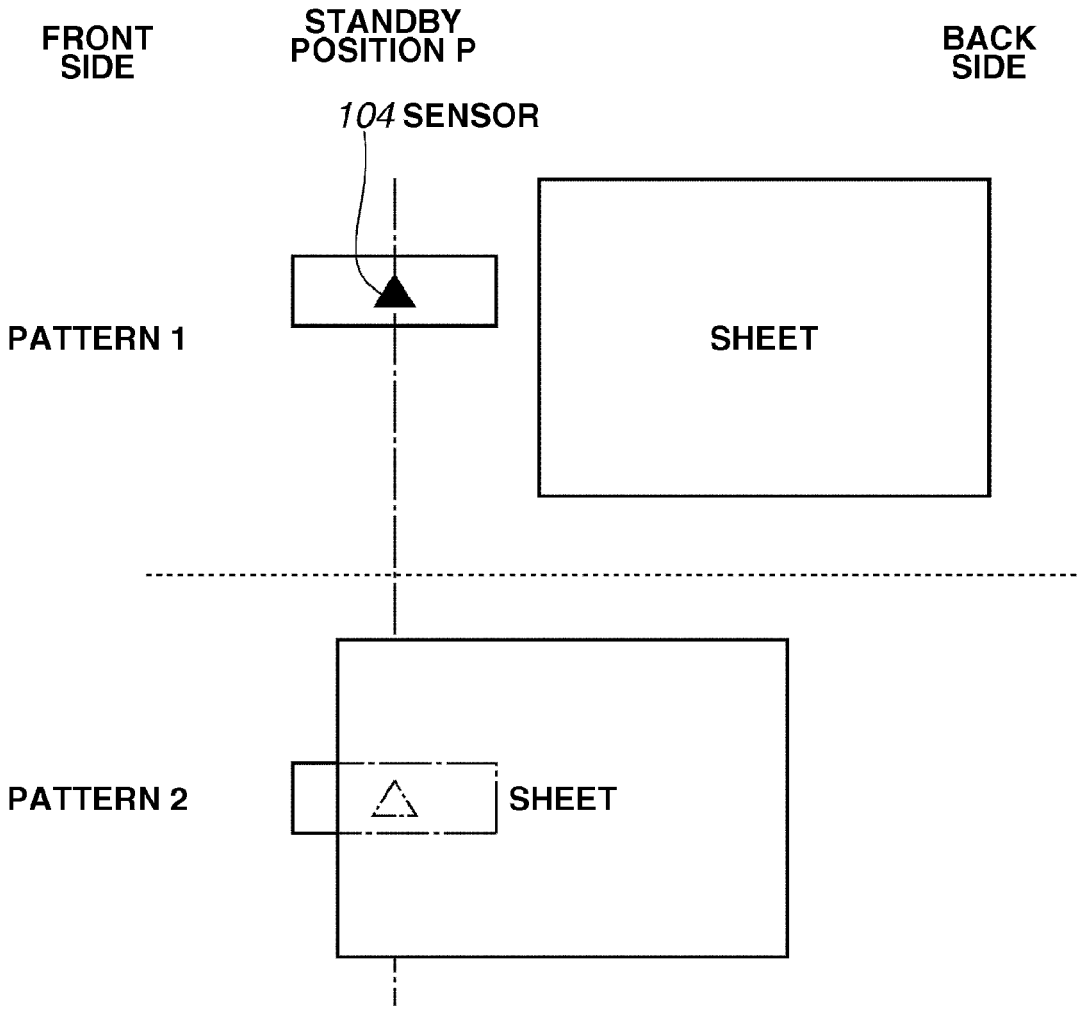
FIG. 8 illustrates detection of a sheet edge.

As illustrated in pattern 1 of FIG. 8, if a sheet is not detected by the lateral registration detection sensor 104 even when the sheet reaches the position of the lateral registration detection sensor 104, the lateral registration detection sensor 104 is shifted in a rearward direction. The lateral registration detection sensor 104 detects the sheet edge when the sensor becomes ON.

As illustrated in pattern 2, if the lateral registration detection sensor 104 detects a sheet when the sheet reaches the position of the lateral registration detection sensor 104, the lateral registration detection sensor 104 is shifted in a forward direction. The lateral registration detection sensor 104 detects a sheet edge when the sensor becomes OFF.

When a print job is completed, the lateral registration detection sensor 104 returns to the home position HP and waits for the start of the next print job.

Figure 9:
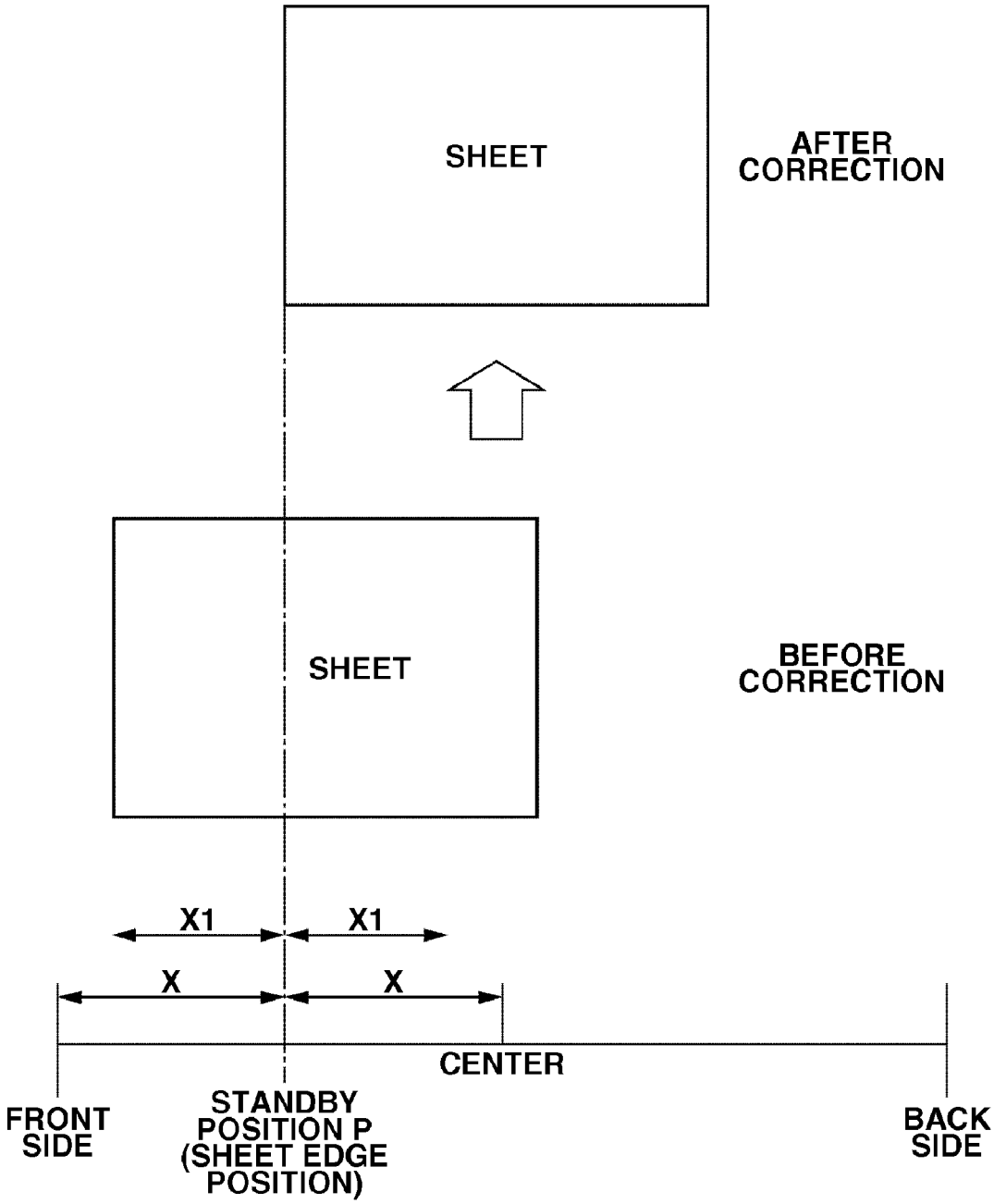
FIG. 9 illustrates lateral registration correction.
Figure 10:
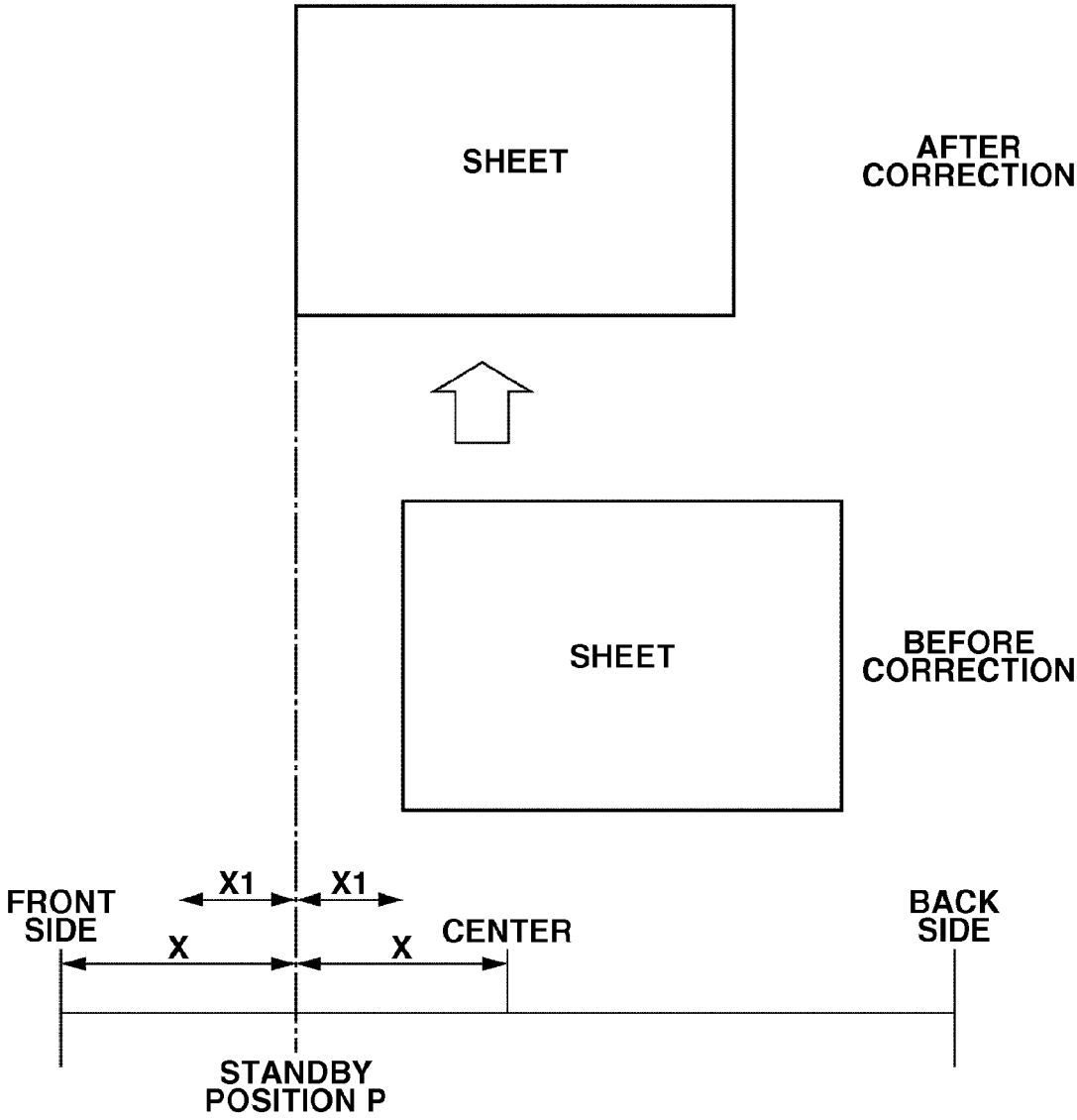
FIG. 10 illustrates the lateral registration correction.

An operation of the lateral registration correction will be described below with reference to FIGS. 9 and 10. As illustrated in FIG. 9, it is assumed that the conveyed sheet is deviated forward by a distance X1 from the standby position P. The sheet is nipped by the conveyance roller pairs 105 and 106 when the sheet is conveyed to the conveyance roller pairs 105 and 106 of the shift unit 108. While the sheet is nipped by the conveyance roller pairs 105 and 106, the frame 108A of the shift unit 108 is shifted rearward by the distance X1 by the shift motor 210. Accordingly, the sheet is shifted rearward in the lateral direction by the distance X1.

On the other hand, if the sheet is deviated rearward, the operation will be performed in a reverse order. In other words, it is assumed that the conveyed sheet is deviated rearward from the standby position P by the distance X1 as illustrated in FIG. 10. The shift motor 210 causes the frame 108A of the shift unit 108 to shift forward by the distance X1. Accordingly, the sheet is shifted forward in the lateral direction by the distance X1 in order to correct the lateral deviation of the sheet.

As described above, the shift unit 108 shifts the sheet in the lateral direction so that the sheet edge in the lateral direction coincides with the reference position (standby position P where there is no lateral deviation of the sheet). That is, the center position of the sheet is matched with the center position of the sheet conveyance path. The shift unit 108 shifts the sheet edge to the reference position and returns to a standby position (not illustrated).

Figure 11:
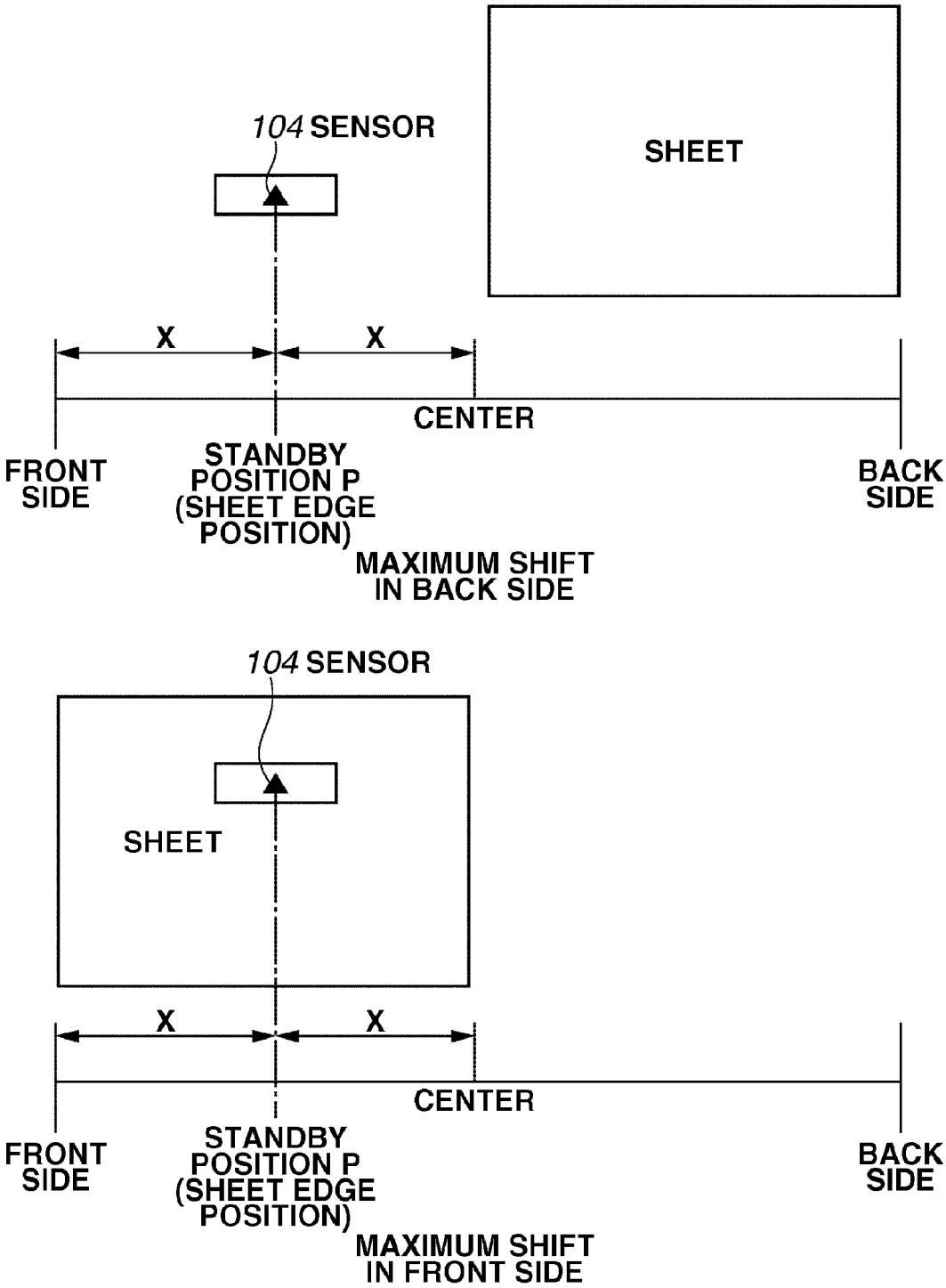
FIG. 11 illustrates a maximum correction amount of lateral registration.

A maximum correction amount when the lateral registration correction is performed will be described below with reference to FIG. 11. It is assumed that the maximum shifting amount or distance the shift motor 210 can move the shift unit 108 by, i.e., the maximum correction amount of the lateral registration correction in the finisher, is a distance X as illustrated in FIG. 11 and time required for the correction from distance X is correction time T. The maximum correction amount X is defined to have a same distance from either side of the standby position P (i.e. to the front side and to the rear side). Accordingly, the maximum shift distances of the lateral registration detection sensor 104 are the same when the sheet is deviated forward, and when deviated rearward from the sheet edge position P. The lateral registration correction is operated based on the correcting time T, at which the shifting amount in the lateral registration correction is the maximum correction distance X, as a reference.

Figure 12:
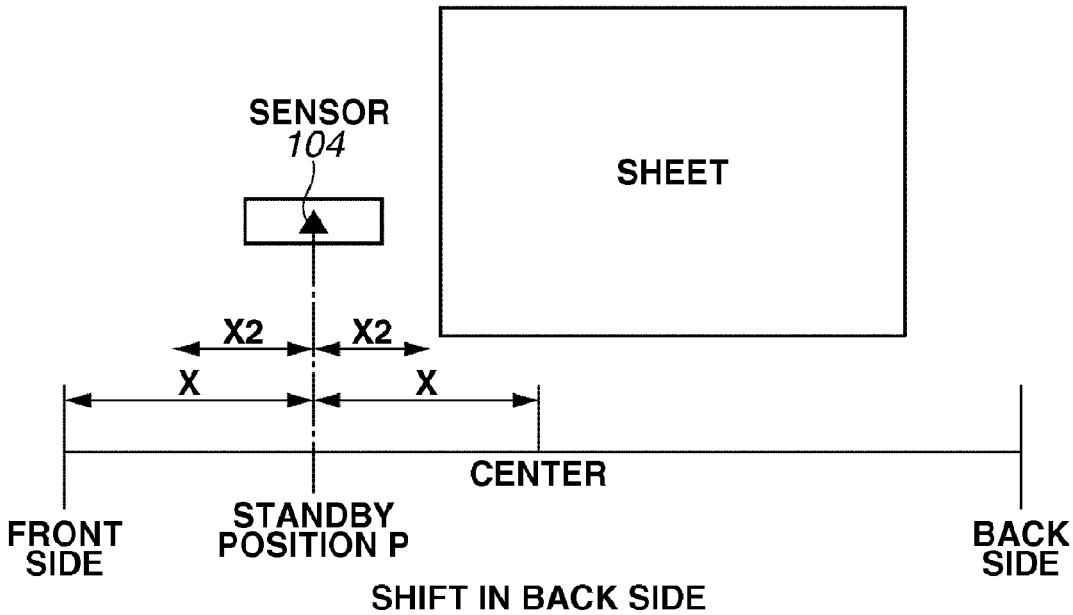
FIG. 12 illustrates a maximum correction amount of the lateral registration.
Figure 12:
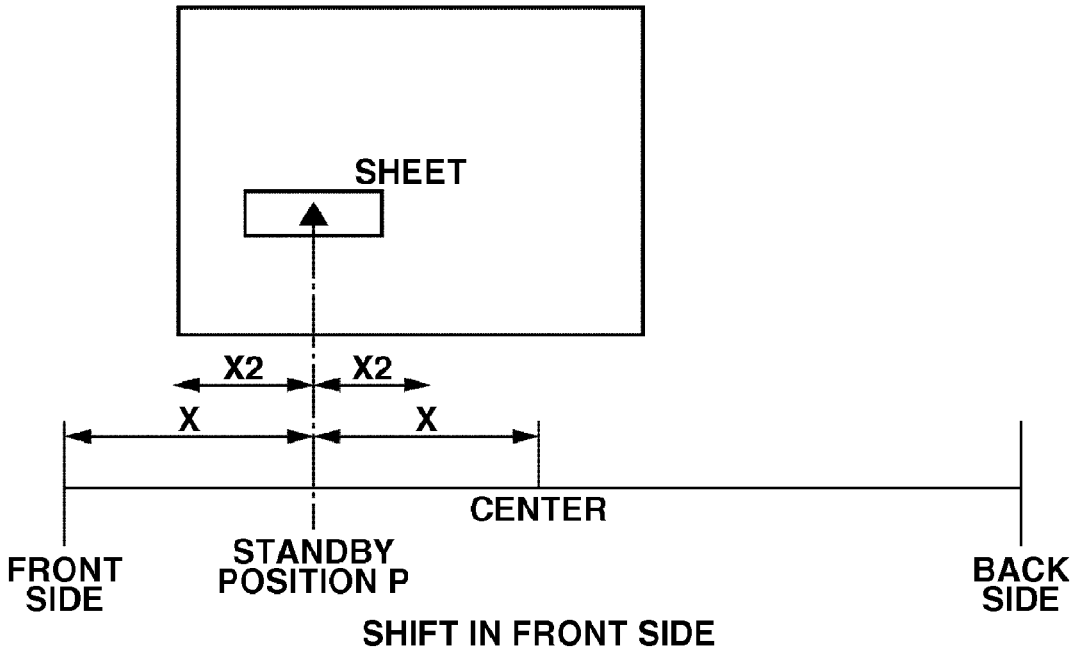
Figure 13:
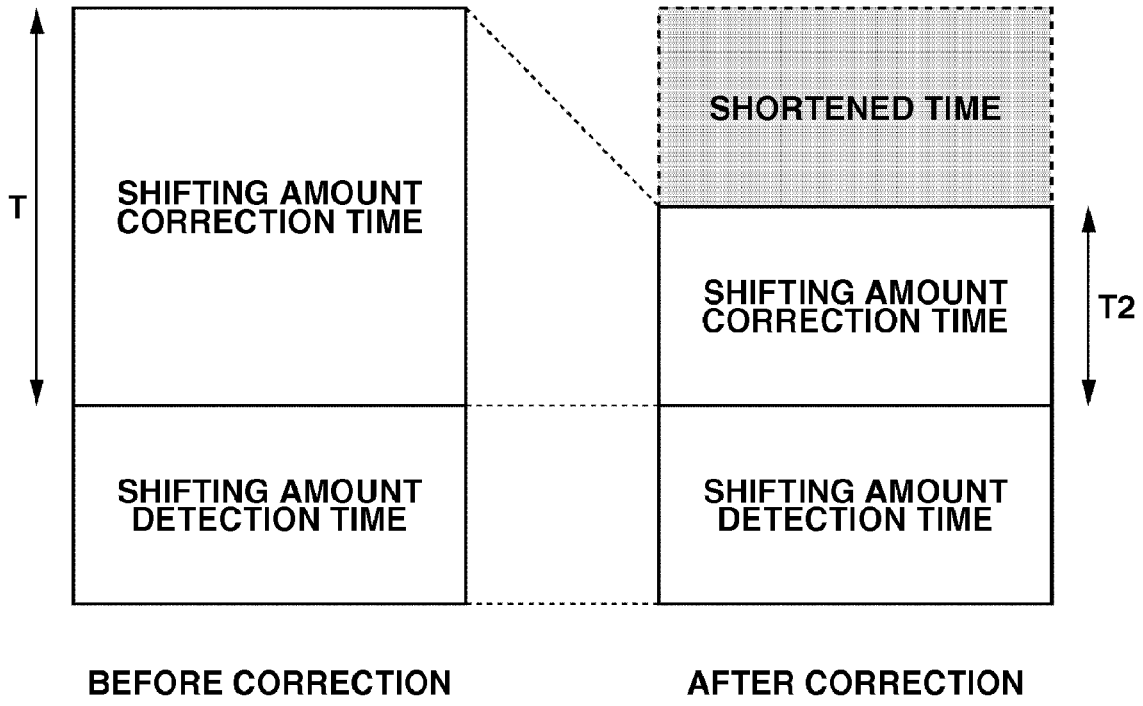
FIG. 13 illustrates a time period required for correcting the lateral registration.

A process for limiting a range of the lateral registration correction which is a feature of the present invention will be described below with reference to FIG. 12. Even if the conveyed sheet is deviated by the maximum distance X from the standby position P, the sheet is conveyed with a sheet conveyance interval during which the shift unit 108 can correct the lateral deviation. It is assumed that time T2 is required for correcting when the deviation amount from the standby position P is a distance X2, where X2 is half of the maximum distance X, as illustrated in FIG. 12. At this time, the shifting amount or distance of the shift unit 108 becomes half compared with a case where the lateral deviation amount is the maximum distance X. Therefore, as illustrated in FIG. 13, the correcting time is shortened by time (T−T2).

When the maximum shifting amount of the lateral registration detection sensor 104 and the maximum correction amount of the shift unit 108 are reduced to the distance X2, the sheet conveyance interval of the image forming apparatus is also shortened. However, if the lateral deviation amount of a sheet which is conveyed by the shortened sheet conveyance interval becomes larger than the distance X2, the lateral registration detection sensor 104 cannot detect the sheet edge. Even if the lateral registration detection sensor 104 can detect the lateral deviation amount by shifting more than the distance X2, the lateral registration detection sensor 104 does not have time to return to the standby position P before the next sheet arrives. As a result, the lateral registration detection sensor 104 may not accurately detect the lateral deviation amount of the next sheet. Furthermore, if the shift unit 108 is shifted for more than distance X2, the shift unit 108 also does not have time to return to the standby position before the next sheet arrives. As a result, the next sheet may come into contact with the shift unit 108, which causes jamming of sheets. Therefore, in order to prevent such inconvenience, the shifting distance (the maximum shifting distance) of the lateral registration detection sensor 104 and the shifting distance (the maximum correction amount) of the shift unit 108 are controlled.

In the first exemplary embodiment, productivity can be improved by reducing the sheet conveyance interval in the image forming apparatus 300, for example, a sheet feeding interval from the paper feed unit 909, i.e., a sheet discharging interval from the image forming apparatus 300.

Figure 14:
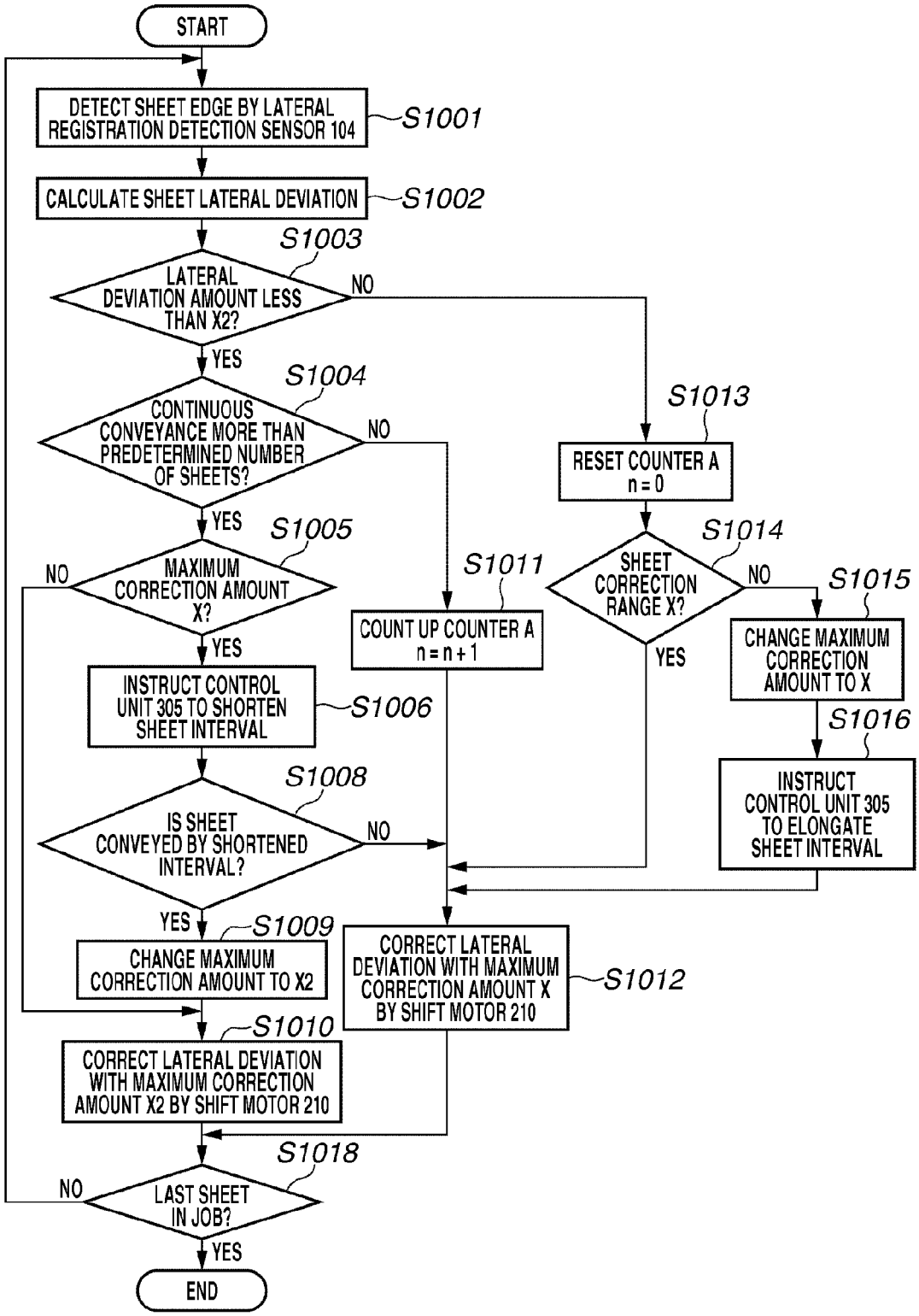
FIG. 14 is a flow chart illustrating lateral registration correction processing of a sheet.

FIG. 14 is a flow chart illustrating lateral registration correction processing of a sheet. The lateral registration correction processing is executed by the CPU 401 based on the program stored in the ROM 402.

In step S1001, the CPU 401 as the control unit detects the sheet edge with the lateral registration detection sensor 104 by driving the pulse motor 104M when the job is started and the sheet is conveyed into the sheet processing apparatus. In step S1002, the CPU 401 computes the lateral deviation amount of the sheet based on the position of the detected sheet edge. In other words, the CPU 401 works as a computing unit for computing the lateral deviation amount of the sheet. In step S1003, the CPU 401 determines whether the computed sheet deviation amount is equal to or less than a predetermined amount. In the particular example the predetermined amount corresponds to the above-described distance X2. The predetermined amount is not necessarily the distance X2 but can be any value smaller than the distance X. If the CPU 401 determines that the computed lateral deviation amount of the sheet is equal to or less than the predetermined amount, namely the distance X2 (YES in step S1003), the process proceeds to step S1004.

In step S1004, the CPU 401 determines whether more than a predetermined number of sheets (for example, five sheets), having a lateral deviation amount equal to or less than the predetermined amount, have been consecutively conveyed. The determination is made based on a value of a counter (hereinafter referred to as a "counter A"), which counts up a number of consecutively conveyed sheets of which lateral deviation amounts are equal to or less than the predetermined amount. The counter A is included in the RAM 403. The predetermined number of sheets need not be restricted to five sheets, but may be any number greater than two sheets.

If the CPU 401 determines that more than the predetermined number of sheets have been consecutively conveyed in step S1004 (YES in step S1004), then in step S1005, the CPU 401 determines whether the present maximum correction amount is X. If the CPU 401 determines that the maximum correction amount is X in step S1005 (YES in step S1005), then in step S1006, the CPU 401 sends an instruction to shorten the sheet conveyance interval to the image forming apparatus control unit 305. In other words, the CPU 401 functions as a conveyance interval control unit. In response to this instruction, the sheet conveyance interval is shortened by the image forming apparatus control unit 305 to the maximum correction time minus time period (T−T2), while the maximum sheet correction range is reduced from the distance X to the distance X2. The image forming apparatus control unit 305 which has received the instruction changes the sheet conveyance interval from the image forming apparatus 300 to the sheet processing apparatus 100, from an interval B1 to an interval B2 which is narrower than the interval B1 by the time (T−T2). There may be one or more sheets already in conveyance within the image forming apparatus when the instruction to shorten the image conveyance interval is received by the image forming apparatus control unit 305. The image conveyance interval of these one or more sheets will thus not be shortened.

In step S1008, the CPU 401 determines, based on the information data about sheet conveyance interval received from CPU 310, whether the sheet is itself a sheet for which the sheet conveyance interval between it and the previous sheet has been shortened by the image forming apparatus control unit 305. If the CPU 401 determines that the sheet has been conveyed with the shortened sheet conveyance interval (YES in step S1008), then in step S1009, the CPU 401 changes the maximum correction amount of the conveyed sheet from X to X2. Accordingly, the maximum correcting time is shortened from T to T2. In step S1010, the CPU 401 corrects the lateral deviation of the conveyed sheet by the shift motor 210 based on the maximum correction amount X2, i.e., the maximum correction amount of the sheet for which the sheet conveyance interval has been shortened. In other words, the CPU 401 functions as a position correction unit. The maximum shifting amount of the lateral registration detection sensor 104, when the lateral deviation amount of the conveyed sheet is detected, is also reduced from the distance X to the distance X2.

On the other hand, if the CPU 401 determines, based on the information data about sheet conveyance interval received from the CPU 310, that the sheet is a sheet for which the conveyance interval between it and the previous sheet has not been shortened in step S1008 (NO in step S1008), then in step S1012, the CPU 401 corrects the lateral deviation by the shift motor 210 based on the maximum correction amount of X.

If the CPU 401 determines that the present maximum correction amount is not X but has already changed to X2 in step S1005 (NO in step S1005), then in step S1010, the CPU 401 corrects the lateral deviation of the sheet, for which the sheet conveyance interval between it and the previous sheet has been shortened, by the shift motor 210 based on the maximum correction amount of X2.

If the CPU 401 determines that fewer than or equal to the predetermined number of sheets, for which lateral deviation amount is equal to or less than the predetermined amount, have been continuously conveyed in step S1004 (NO in step S1004), then in step S1011, the CPU 401 increments the counter A by 1. In step S1012, the CPU 401 corrects the lateral deviation of the sheet based on the maximum correction amount of X.

If the CPU 401 determines that the lateral deviation amount of the sheet is greater than the predetermined amount (NO in step S1003), then in step S1013, the CPU 401 resets the counter value of the counter A to 0. In step S1014, the CPU 401 determines whether the present maximum correction amount is X. If the CPU 401 determines that the maximum correction amount is X in step S1014 (YES in step S1014), then in step S1012, the CPU 401 corrects the lateral deviation of the sheet based on the maximum correction amount of X.

If the CPU 401 determines that the maximum correction amount is not X in step S1014 (NO in step S1014), then in step S1015, the CPU 401 changes the maximum correction amount to X and instructs the image forming apparatus control unit 305 to elongate the sheet conveyance interval by (T−T2). The image forming apparatus control unit 305, when the instruction is received, elongates the sheet conveyance interval by (T−T2) from the interval B2 and returns or resets the interval to the interval B1. Accordingly, the sheet conveyance interval of the image forming apparatus 300 to the sheet processing apparatus 100 becomes the same interval as that when the maximum correction amount is X. There may be one or more sheets already in conveyance within the image forming apparatus when the instruction to elongate the sheet conveyance interval is received by the image forming apparatus control unit 305. However, although these one or more sheets already in conveyance will not have an elongated conveyance interval, the risk of any collision or jamming is negligible since the lateral deviation amount of the sheet gradually changes. In step S1012, the CPU 401 corrects the lateral deviation of the sheet conveyed based on the maximum correction amount of X. Accordingly, the maximum shifting amount of the lateral registration detection sensor 104 for detecting the lateral deviation amount of the sheet is changed from the distance X2 to the distance X.

The above-described processing is performed on each of the sheets conveyed to the sheet processing apparatus 100 from a start to an end of a print job. More specifically, in step S1018, after the processing of step S1010 or S1012, the CPU 401 determines whether the conveyed sheet is the last sheet to be printed. If the sheet is not the last one (NO in step S1018), the processing returns to step S1001.

In the first exemplary embodiment, two values are set as the maximum correction amount of the lateral deviation of the sheet. However, more than two values may be set as the maximum correction amount, and the lateral deviation amount computed in step S1003 can be compared with predetermined amounts of the more than two values of the maximum correction amounts. In this case, the sheet conveyance interval may be changed based on the more than two values of the maximum correction amounts.

A configuration of the image forming apparatus in a second exemplary embodiment has the same configuration as the first exemplary embodiment, so that a description thereof will be omitted here.

If a plurality of types of sheets is used in one print job, it is possible that a sheet feed unit is switched while the print job is executed. When the maximum correction amount of the sheet is X2, if the sheet feed unit is switched from a first sheet feed unit to a second sheet feed unit while the print job is executed, the lateral deviation amount of the sheet from the second feed unit may become different from that of a sheet from the first feed unit. Therefore, in the second exemplary embodiment, the sheet processing apparatus control unit 501 resets the maximum correction amount of the sheet to X when the sheet feed unit is switched. The maximum correction amount is changed back to X2 when more than the predetermined number of sheets, for which the lateral deviation amount is equal to or less than the predetermined amount, are consecutively conveyed.

Figure 15:
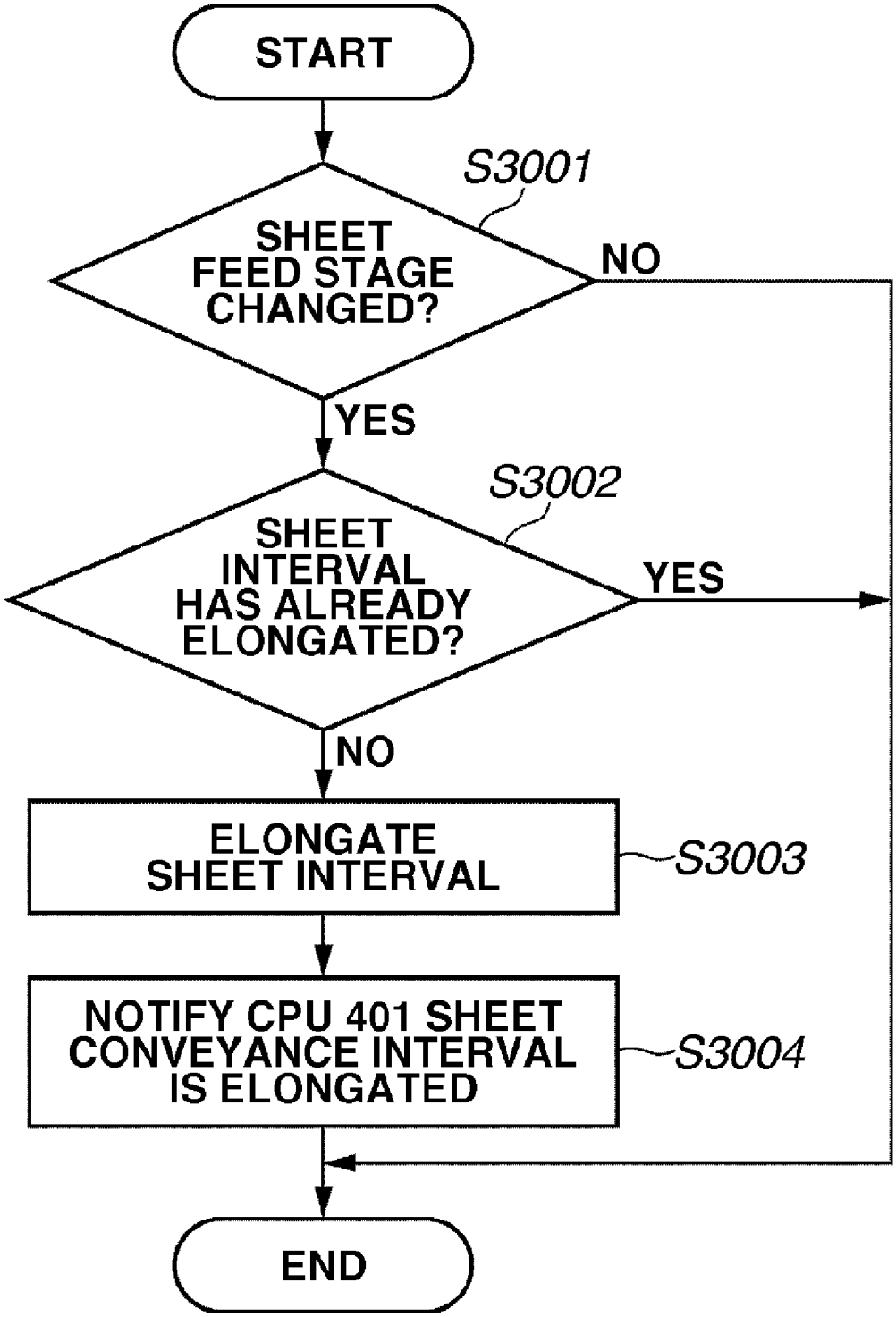
FIG. 15 is a flow chart illustrating a change of a sheet conveyance interval.

The processing will be described below with reference to FIGS. 15 and 16. FIG. 15 illustrates steps which are executed when the image forming apparatus 300 switches the sheet feed unit during an image forming job. The CPU 310 executes the processing illustrated in the flow chart based on the program stored in the ROM 306.

In step S3001, the CPU 310 determines whether the sheet feed unit has been switched. If the CPU 310 determines that the sheet feed unit has been switched (YES in step S3001), then in step S3002, the CPU 310 determines whether the sheet feeding interval from the sheet feed unit is already elongated. More specifically, the CPU 310 determines whether the sheet feeding interval is B1. If the CPU 310 determines that the sheet feeding interval is not elongated (not the interval B1) (NO in step S3002), the process proceeds to step S3003. In step S3003, the CPU 310 sets the sheet feeding interval to B1. In step S3004, the CPU 310 sends information indicating that the sheet conveyance interval has been elongated to the CPU 401 of the sheet processing apparatus 100, i.e., information indicating that the sheet feeding interval is now set to B1.

Figure 16:
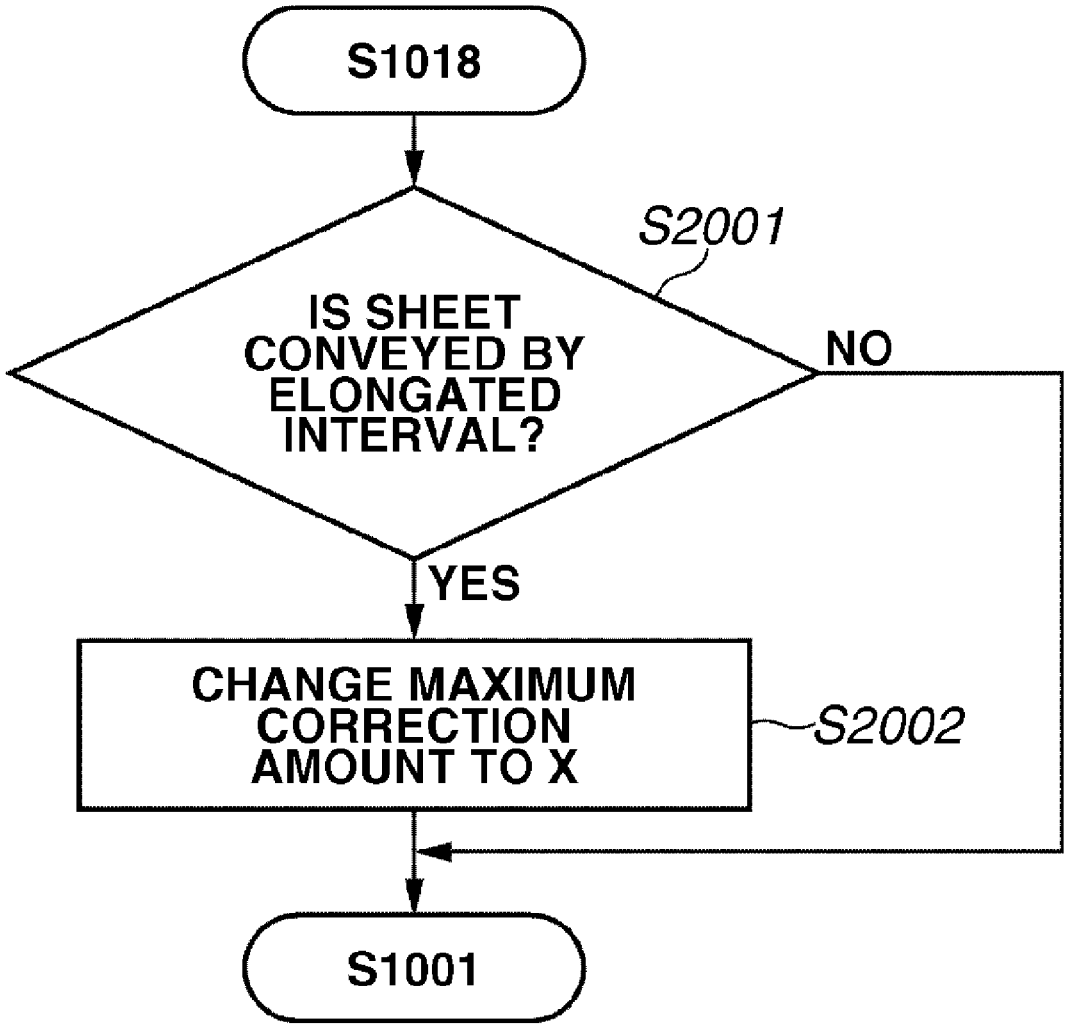
FIG. 16 is a flow chart illustrating a change of a sheet correction range.

FIG. 16 is a flow chart of the processing which is executed by the CPU 401 of the sheet processing apparatus 100 when the sheet feed unit is switched. The processing illustrated in the flow chart of FIG. 16 is executed when the result of step S1018 of FIG. 14 is "NO".

In step S2001, the CPU 401 determines whether the sheet conveyance interval between the previous sheet from a first sheet feed unit and the next sheet from the second sheet feed unit has been elongated, in accordance with the switching of the sheet feed unit, even though no instruction to elongate the sheet conveyance interval has been sent to the CPU 310 by the CPU 401. More specifically, the above-described determination by the CPU 401 is made based on whether the CPU 401 received from the CPU 310 information indicating that the sheet conveyance interval has been elongated. If the CPU 401 determines that the sheet conveyance interval has been elongated in step S2001 (YES in step S2001), then in step S2002, the CPU 401 changes the maximum correction amount of the sheet from the second sheet feed unit from X2 to X, i.e., increases the maximum correction amount of the sheet from the second sheet feed unit from X2 to X, and resets the counter A. At the same time, the maximum shifting distance of the lateral registration detection sensor 104 is also increased from X2 to X. The processing then returns to step S1001 of FIG. 14.

The above-described processing is performed on each of the sheets conveyed to the sheet processing apparatus 100 from the start to the end of the print job. Even if the CPU 401 determines that more than the predetermined number of sheets, for which lateral deviation amount is equal to or less than the predetermined amount, have been continuously conveyed, the CPU 401 chooses to change the maximum correction amount of the sheet to X when the CPU 401 receives a notification from the CPU 310 that the sheet conveyance interval has been elongated.

The CPU 310 can be configured to notify that the sheet conveyance interval is elongated based on a change of a sheet material to be conveyed, alternatively or in addition to the switching of the sheet feed unit.

The predetermined value in step S1003 of FIG. 14 and the predetermined number of sheets in step S1004 are both changeable. Examples of screens for changing the predetermined value and the predetermined number of sheets are illustrated in FIGS. 17A and 17B.

Figure 17A:
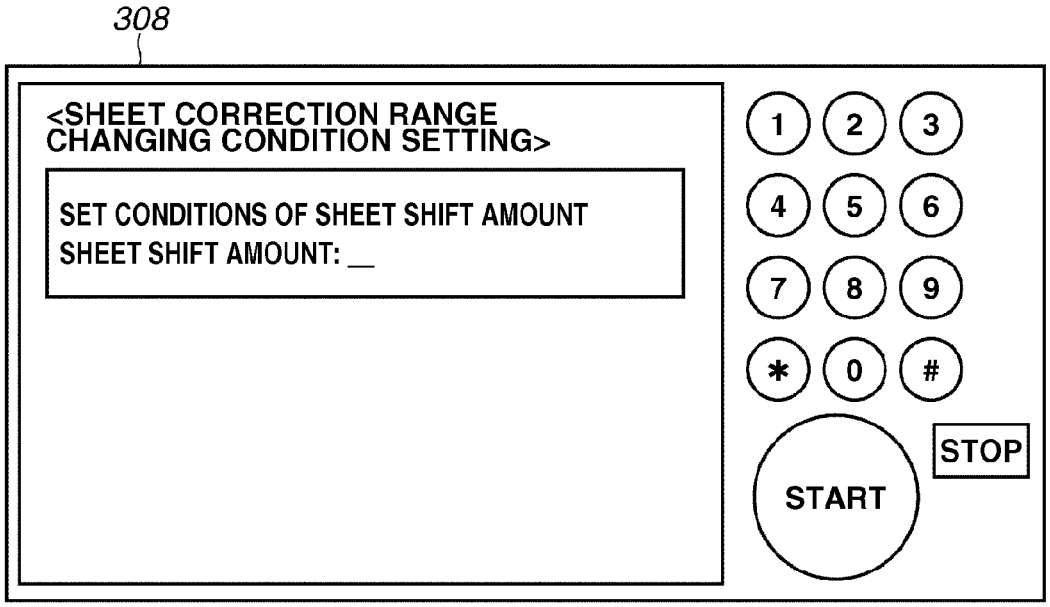
FIGS. 17A and 17B illustrate condition setting screens for changing sheet correction ranges.
Figure 17B:
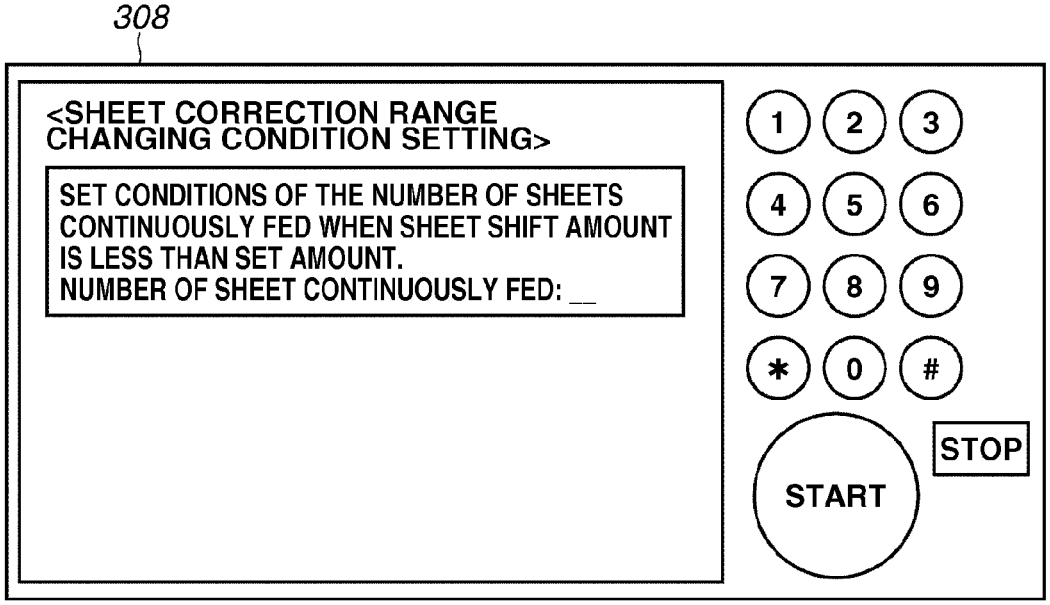

FIG. 17A is a setting screen for the predetermined value of step S1003. FIG. 17B is a setting screen for the predetermined number of sheets of step S1004. These setting screens are displayed on the operation unit 308. For example, a history of the lateral deviation amounts of the sheets which is measured in step S1002 is stored in the RAM 403, and an average value, a maximum value, a minimum value, and the like of the stored lateral deviation amounts are displayed on the operation unit 308. A user or a service person can set the predetermined amount or the predetermined number of sheets while viewing the displayed values. For example, as the average value of the lateral deviation amount of the sheet becomes smaller, smaller values can be set for both of the predetermined amount and the predetermined number of sheets. Accordingly, productivity can be improved. As described above, since operation conditions can be set via the operation unit, appropriate conditions can be set according to a job to be executed or a system configuration of an apparatus to be connected.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-171735 filed Jun. 30, 2008, which is hereby incorporated by reference herein in its entirety.

What is claimed is:

1. A sheet conveying apparatus comprising:

a first conveyance unit configured to convey a sheet;

a second conveyance unit configured to convey the sheet received from the first conveyance unit;

a sheet detection unit configured to detect an edge position of the sheet in a lateral direction intersecting a sheet conveyance direction of the second conveyance unit;

a sheet shifting unit configured to shift the sheet conveyed by the second conveyance unit in the lateral direction;

a computing unit configured to compute a difference between the sheet edge position detected by the sheet detection unit and a reference position;

a position correction unit configured to control a shifting amount of the sheet to be shifted by the sheet shifting unit based on the difference computed by the computing unit in order to correct a position of the sheet in the lateral direction; and a conveyance interval control unit configured to shorten a sheet conveyance interval of the first conveyance unit when the difference computed by the computing unit is equal to or less than a predetermined amount.

2. The sheet conveying apparatus according to claim 1, further comprising:

a counter configured to count a number of sheets which are consecutively conveyed as long as the difference computed by the computing unit is equal to or less than the predetermined amount, wherein the conveyance interval control unit shortens the sheet conveyance interval of the first conveyance unit when the number of sheets counted by the counter reaches a predetermined number.

3. The sheet conveying apparatus according to claim 1, wherein the position correction unit reduces a maximum amount to be shifted by the sheet shifting unit when the difference computed by the computing unit is equal to or less than the predetermined amount.

4. The sheet conveying apparatus according to claim 1, wherein the sheet detection unit includes a sensor configured to detect the sheet and a sensor shifting unit configured to shift the sensor in the lateral direction in order to detect the sheet edge position, and wherein the position correction unit reduces a maximum amount to be shifted by the sensor shifting unit with respect to the sheet of which the sheet conveyance interval has been shortened when the difference computed by the computing unit is equal to or less than the predetermined amount.

5. The sheet conveying apparatus according to claim 3, wherein the first conveyance unit feeds a sheet from any one of a plurality of feeding units configured to feed sheets and, elongates the sheet conveyance interval when the feeding unit to be used is switched after the conveyance interval control unit has shortened the sheet conveyance interval of the first conveyance unit.

6. The sheet conveying apparatus according to claim 5, wherein the position correction unit increases the maximum amount to be shifted by the sheet shifting unit when the first conveyance unit elongates the sheet conveyance interval.

7. The sheet conveying apparatus according to claim 6, wherein the position correction unit increases the maximum amount to be shifted by the sensor shifting unit when the edge position of the sheet in which the sheet conveyance interval is elongated is detected, if the first conveyance unit elongates the sheet conveyance interval.

8. A sheet conveying apparatus which conveys a sheet received from an upstream side device for conveying sheets, the sheet conveying apparatus comprising:

a conveyance unit configured to convey a sheet;

a sheet detection unit configured to detect an edge position of the sheet in a lateral direction intersecting a sheet conveyance direction of the conveyance unit;

a sheet shifting unit configured to shift the sheet conveyed by the conveyance unit in the lateral direction;

a computing unit configured to compute a difference between the edge position of the sheet detected by the sheet detection unit and a reference position;

a position correction unit configured to control a shifting amount of the sheet shifted by the sheet shifting unit based on the difference computed by the computing unit in order to correct a position of the sheet in the lateral direction; and a conveyance interval control unit configured to send to the device on the upstream side an instruction to shorten a sheet discharge interval if the difference computed by the computing unit is equal to or less than a predetermined amount.

9. The sheet conveying apparatus according to claim 8, wherein the position correction unit increases a maximum amount to be shifted by the sheet shifting unit when the position correction unit receives from the upstream side device information indicating that the sheet conveyance interval is elongated.

10. The sheet conveying apparatus according to claim 8, wherein the sheet detection unit includes a sensor configured to detect the sheet and a sensor shifting unit configured to shift the sensor in the lateral direction in order to detect the edge position of the sheet, and wherein the position correction unit reduces a maximum amount to be shifted by the sensor shifting unit when the computing unit receives from the upstream side device the information indicating that the sheet conveyance interval is elongated.

11. An image forming apparatus comprising:

a storing unit configured to store sheets;

a feeding unit configured to feed a sheet stored in the storing unit;

an image forming unit configured to form an image on the sheet fed by the feeding unit;

a conveyance unit configured to convey the sheet on which the image is formed by the image forming unit;

a sheet detection unit configured to detect a sheet edge position in a lateral direction intersecting a sheet conveyance direction of the conveyance unit;

a sheet shifting unit configured to shift the sheet conveyed by the conveyance unit in the lateral direction;

a computing unit configured to compute a difference between the edge position of the sheet detected by the sheet detection unit and a reference position;

a position correction unit configured to control a amount to be shifted by the sheet shifting unit based on the difference computed by the computing unit in order to correct a position of the sheet in the lateral direction; and a conveyance interval control unit configured to shorten a sheet conveyance interval of the conveyance unit when the difference computed by the computing unit is equal to or less than a predetermined amount.

12. The image forming apparatus according to claim 11, wherein the position correction unit reduces a maximum amount to be shifted by the sheet shifting unit when the difference computed by the computing unit is equal to or less than the predetermined amount.

13. The image forming apparatus according to claim 12, wherein the sheet detection unit includes a sensor configured to detect the sheet and a sensor shifting unit configured to shift the sensor in the lateral direction, in order to detect the edge position of the sheet, and wherein the position correction unit reduces a maximum amount to be shifted by the sensor shifting unit when the edge position of the sheet of which the sheet conveyance interval is shortened is detected, if the computed difference is equal to or less than the predetermined amount.

* * * * *